US010107517B2

(12) United States Patent
Szabo et al.

(10) Patent No.: US 10,107,517 B2
(45) Date of Patent: Oct. 23, 2018

(54) COOLING SYSTEM

(71) Applicant: GEA EGI Energiagazdálkodási Zrt., Budapest (HU)

(72) Inventors: Zoltan Szabo, Budapest (HU); Andras Dancsuly, Pilisvorosvar (HU)

(73) Assignee: GEA EGI Energiagazdalkodasi ZRT., Budapest (HU)

( * ) Notice: Subject to any disclaimer, the term of this patent is extended or adjusted under 35 U.S.C. 154(b) by 1061 days.

(21) Appl. No.: 14/369,889

(22) PCT Filed: Jan. 10, 2013

(86) PCT No.: PCT/HU2013/000007

§ 371 (c)(1),
(2) Date: Jun. 30, 2014

(87) PCT Pub. No.: WO2013/104939

PCT Pub. Date: Jul. 18, 2013

(65) Prior Publication Data

US 2014/0335777 A1 Nov. 13, 2014

(30) Foreign Application Priority Data

Jan. 12, 2012 (HU) ..... 1200021

(51) Int. Cl.

| | |
|---|---|
| ***F24F 7/00*** | (2006.01) |
| ***F24F 13/08*** | (2006.01) |
| ***F28B 1/06*** | (2006.01) |
| ***F24F 7/04*** | (2006.01) |

(52) U.S. Cl.
CPC ..... *F24F 13/08* (2013.01); *F24F 7/04* (2013.01); *F28B 1/06* (2013.01)

(58) Field of Classification Search
CPC ..... F24F 6/04; F24F 5/0035; B01D 29/21
USPC ..... 454/309; 126/113; 261/100–107; 62/304, 316
See application file for complete search history.

(56) References Cited

U.S. PATENT DOCUMENTS

| | | | | |
|---|---|---|---|---|
| 3,727,679 A * | 4/1973 | Von Cleve | ..... | F28B 1/06 165/111 |
| 3,933,196 A | 1/1976 | Heller et al. | | |
| 4,156,351 A * | 5/1979 | Schlom | ..... | F24F 3/14 62/121 |

(Continued)

FOREIGN PATENT DOCUMENTS

| | | |
|---|---|---|
| EP | 0220607 | 5/1987 |
| GB | 971480 | 9/1964 |

OTHER PUBLICATIONS

International Search Report (3 pgs.) and Written Opinion of the International Searching Authority (6 pgs.), European Patent Office, dated May 16, 2013.

*Primary Examiner* — Vivek Shirsat
(74) *Attorney, Agent, or Firm* — Wood Herron & Evans LLP

(57) ABSTRACT

The invention is a cooling system comprising adjacent cooling deltas (21, 31) being cooled by a cooling air and being arranged along a path (20, 30). The cooling system is characterized by comprising cooling deltas (21, 31) arranged in groups (22), the cooling deltas of a group (22) being arranged essentially in the same orientation and define an essentially straight path-section, wherein the path-sections of adjacent groups (22) form a zigzagged path (20, 30).

13 Claims, 6 Drawing Sheets

(56) References Cited

U.S. PATENT DOCUMENTS

| | | | | |
|---|---|---|---|---|
| 4,159,738 | A | 7/1979 | Sedille | |
| 2010/0276129 | A1* | 11/2010 | Bodas | F01K 9/00 165/157 |

* cited by examiner

COOLING SYSTEM

This application claims priority, under Section 371 and/or as a continuation under Section 120, to PCT Application No. PC/HU2013/000007, filed on Jan. 10, 2013, which claims priority to Hungary Application No. P 12 00021, filed on Jan. 12, 2012.

TECHNICAL FIELD

The invention relates to dry air-cooling systems and dry-wet cooling systems of industrial and power plant processes. The invention can be used primarily for cooling of high capacity units, especially in natural draft cooling towers.

BACKGROUND ART

In air-cooling systems, process-heat removal is carried out by means of convective heat transfer by ambient air via bundles of surface heat exchangers. This requires a very large air-cooling surface even in the case of a medium-sized process or power plant block.

It is a long used technique for reducing the footprint (footing area) of air coolers and dry cooling towers not to dispose the air-cooling bundles adjacently to each other in one plane, i.e. perpendicular to the original air flow direction, but to arrange those at angles significantly less than 180° (e.g. 60°) with respect to each other. So, the front face of the air-cooling bundles (columns) is arranged at an angle less than perpendicular to the original flow direction of the cooling air. Therefore, the front face and the surface of air-coolers on a given footprint or around at a given diameter can be successfully increased within certain limits.

Various arrangements have been developed so far, nevertheless, in case of high- or even medium-capacity air-coolers, almost exclusively the air-cooling arrangement resulting the aforementioned "folded" air flow is applied, irrespective of the fact whether the coolers are horizontally or vertically arranged, or whether it is direct or indirect air-cooling.

As a result of the "folded" arrangement, the air-coolers have multiple V or A-shaped surfaces (i.e. having triangular cross-sections), significantly increasing the front face of the air-coolers arranged in a given footprint, i.e. the cooling capacity of the cooling tower.

A known efficient air-cooling arrangement is applied in the so-called Heller-system. The constructional units of the air coolers, in view of their respective cross section perpendicular to the longitudinal direction, consist of two cooling columns arranged at an angle of $\alpha$=40° to 60° with respect to each other, as legs of an isosceles triangle, where the third side is open (optionally arranged with shutters) for the incoming cooling air. These so-called cooling deltas have been in use since the 1950s (see e.g. in the literature: Balogh, A., Szabó, Z., Advanced Heller System to Improve Economics of Power Generation, EPRI Conference on Advanced Cooling Strategies/Technologies, June 2005, Sacramento, Calif.) and this known arrangement is shown in FIGS. 1-3. Cooling deltas 11 illustrated in top view in FIGS. 1 and 2 and in three-dimensional view in FIG. 3, are disposed in prior art systems vertically along a path 10 having the form of a circle (or a polygon approximating a circle). The path 10 typically follows the base-outline of a cooling tower. According to the invention, path refers to a trace defined by respective points in identical positions of the essentially identically formed cooling deltas. The entire air-cooling surface is made up of the cooling deltas 11. The cooling air exhibits a single-folded flow path indicated by arrows in top view, following the geometry of the individual cooling deltas. The flow of the cooling air is driven by means of a natural draft tower disposed over the arrangement or by means of fans arranged in a vertical plane on the inner or outer side.

The ever increasing demand for cooling capacity of power station blocks, resulting from the demand for increasing the block size and for reaching even lower condensational temperature or cooling water temperature at a given outside temperature, is an increasing challenge for air cooler system manufacturers. These challenges can be overcome by decreasing the angle of the cooling deltas and by increasing their respective lengths (one basic case of this being provided by stacking the separate air coolers one above the other in a storey-like array, as disclosed e.g. in U.S. Pat. No. 3,434,529 or later in US 2010/276129 A1) only to a certain limit, so as to avoid extra costs and decline in efficiency incurred by deteriorating thermal technology and constructional problems. In the case of state-of-the-art, high capacity nuclear power stations, up to three to four natural draft air-cooling towers are required for a single power plant block so that the dry or dry-wet cooling system be competitive in terms of efficiency with wet cooling, which by the way, has significantly higher water-consumption, i.e. is environmentally less desirable. These numbers of cooling towers may cause, especially in the case of a multi-unit nuclear power station premise, serious problems in terms of placement; moreover, efficiency would also be negatively affected by the interference between the towers, GB 971 480 discloses an air-cooled condenser having cooling elements arranged zig-zag in horizontal cross-section.

DESCRIPTION OF THE INVENTION

An object of the invention is to provide a space-efficient air-cooling arrangement (i.e. a heat exchanger for a medium to be cooled by ambient air), which is power and cost efficient, and at the same time enables to exploit the potentials of the novel arrangement.

It has been found that by arranging the presently used cooling deltas with V or A cross-section to form groups with straight paths, adjoining each other in a zigzagged manner, then by having these groups arranged at an angle to each other, a large cooling delta can be provided. The entire air-cooling surface is obtained by further multiplication of these air-cooling segments, hereinafter referred to as 'complex delta units'. Consequently, the initially 'single-folded' flow of cooling air will be turned into a 'double-folded' air flow.

The object has been achieved by the cooling system according to claim 1. Preferred embodiments are defined in the dependent claims.

BRIEF DESCRIPTION OF THE DRAWINGS

Preferred embodiments of the invention are described below by way of example with reference to the following drawings, where.

MODES FOR CARRYING OUT THE INVENTION

The dry or dry/wet cooling systems implementing process-heat removal (either by medium-cooling or by condensation) generally comprise finned tube air coolers, a pipe system distributing/collecting the medium to be cooled (or condensed), and a natural or mechanical draft cooling air moving device. The air coolers consist of units called cooling columns, each having its own inlet/outlet chamber, two of such angularly disposed cooling columns form a cooling delta, which will generate a folded flow of the cooling air.

Figure 1:
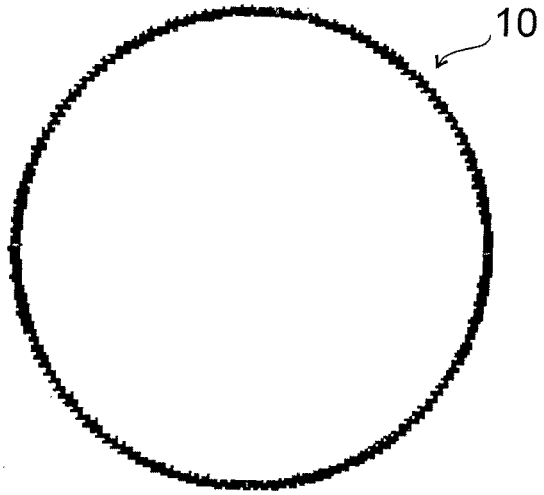
FIG. 1 is a top view of an air-cooling arrangement consisting of prior art cooling deltas arranged along a circular path.
Figure 2:
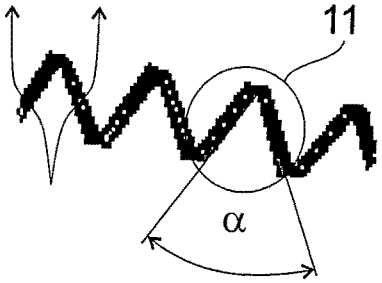
FIG. 2 is a partial top view of the cooling deltas according to FIG. 1 formed by air-cooling columns arranged at an angle to each other.
Figure 3:
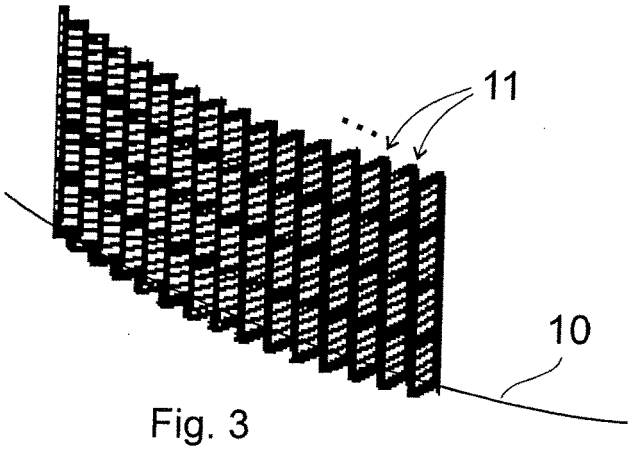
FIG. 3 is an axonometric view of a detail of the cooling delta arrangement according to FIG. 1.
Figure 4:
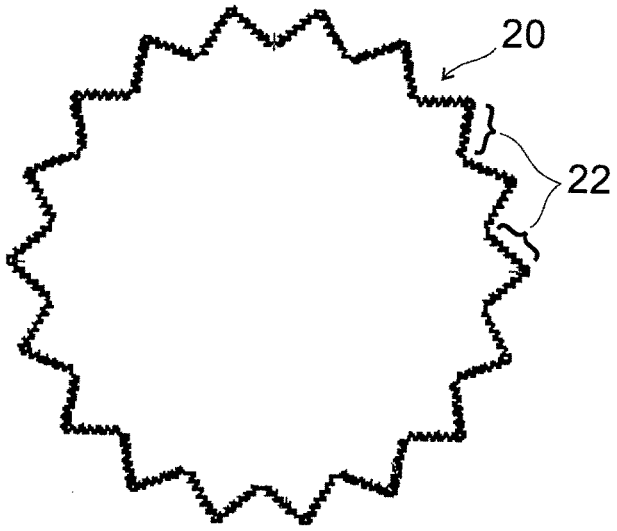
FIG. 4 is a top view of a cooling system according to a preferred embodiment.
Figure 5:
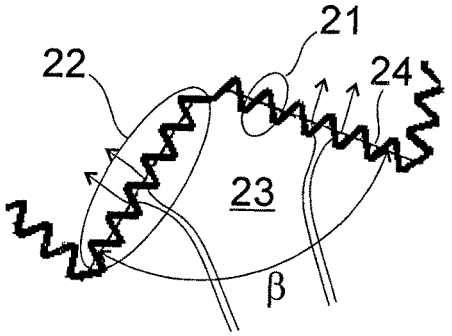
FIG. 5 shows a detail of the air-cooling arrangement according to FIG. 4.

FIG. 4 shows an air-cooling arrangement according to the invention implementing a double-folded air flow, while FIG. 5 shows a detail thereof in top view, with arrows indicating the air flow. In the cooling system according to the invention, adjacently disposed, vertical cooling deltas 21 being cooled by cooling air are arranged into groups 22. The cooling deltas 21 of one group 22 are arranged to have essentially the same orientation, defining an essentially straight (maximum slightly inclined) path-section 24. The respective path-sections 24 of the adjacent groups 22 form a zigzagged path comprising alternating angles along the path. In this preferred embodiment the zigzagged path forms an enclosed star-like configuration.

In the double-folded cooling air flow illustrated in FIG. 5, both folded flows are in the same plane, in conformity with the vertical arrangement of the cooling deltas 21 and complex delta units 23. Preferably, near ground level horizontal distribution pipes supply the individual complex delta units 23 with medium to be cooled or condensed. The collection pipes are also horizontal, in dependence of the medium-side connection of the air-cooling heat exchangers, and are disposed parallel with the distribution pipes near ground level, or at the upper ends of the vertically aligned cooling deltas 21.

In a manner as seen in FIG. 5, the pairs of adjacent groups 22 form complex delta units 23, which are open from an incoming direction of the cooling air. The path-sections 24 of the groups 22 forming the complex delta units 23 are arranged at an angle β to each other.

Figure 6:
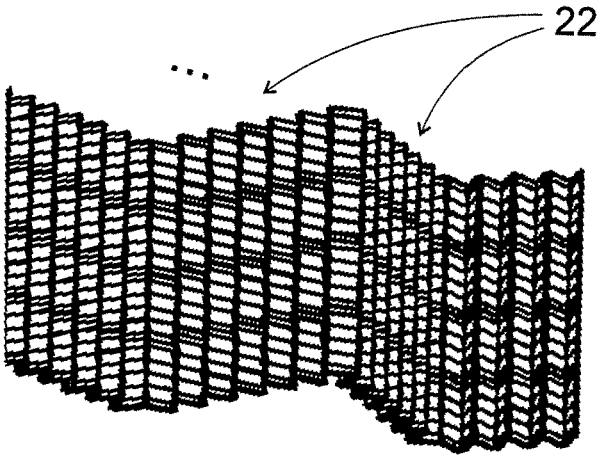
FIG. 6 is an axonometric view of the complex delta units according to FIG. 4 generating a double-folded air flow, being formed by cooling deltas.

The multiplication of the complex delta units shown in the view of FIG. 6 can be done in one plane—horizontally or more preferably—, in the arrangement according to the depicted preferred embodiment, vertically along an arc, ellipse or any combination thereof with straight sections, which gives a star-like top view.

The vertically arranged complex delta units may have various forms. In the case according to FIGS. 4-6, the tubes of the cooling deltas containing medium to be cooled are vertically oriented. Accordingly, the distribution and collection pipes of the complex delta units are inevitably horizontal.

In another case, as presented by FIGS. 7-10, the cooling deltas forming the complex delta units are disposed nearly horizontally, i.e. the direction of the tubes of the medium to be cooled in the cooling deltas differ from the horizontal only by a few degrees required for emptying. Here, distribution and collection pipes 35 of the medium to be cooled of the complex delta units are vertical.

Figure 7:
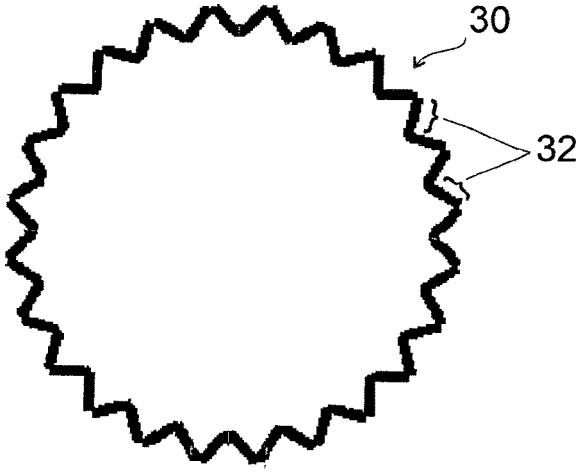
FIG. 7 is a top view of a further preferred embodiment, comprising horizontally disposed cooling deltas.
Figure 8:
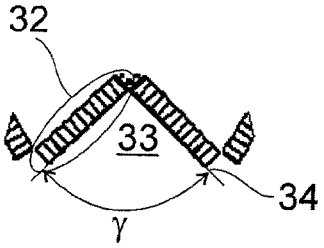
FIG. 8 is a detail of the arrangement according to FIG. 7, being a top view of the groups of horizontally disposed cooling deltas and of the vertical complex delta units composed thereof.
Figure 9:
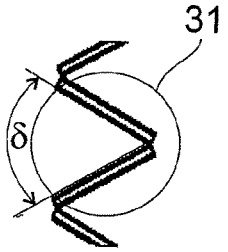
FIG. 9 is a side-view of a detail of the group in the arrangement according to FIG. 7.
Figure 10:
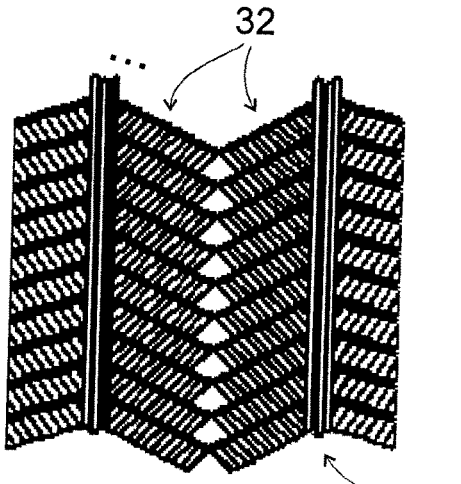
FIG. 10 is an axonometric view of the complex delta units of the arrangement according to FIG. 7.

The zigzagged path 30 illustrated in FIG. 7 characterises the arrangement of groups 32, i.e. of panels made of horizontally cooling deltas 31 (FIG. 9) having an opening angle of δ. The cooling deltas 31 are arranged in groups 32, which in pairs form vertically oriented complex delta units 33 illustrated in FIG. 8. Path-sections 34 characteristic of the groups 32 in the complex delta units 33 close an angle of γ with each other in top view. In FIG. 10 the arrangement is shown with an axonometric view of the vertical complex delta units 33 effecting a double-folded air flow, and being formed of horizontally disposed cooling deltas 31.

A double-folded cooling air flow is generated in this embodiment as well, however, as the cooling deltas 31 are horizontally disposed, and the complex delta units 33 are vertically oriented, the two folded air flows are generated in planes perpendicular to each other.

The air-cooling arrangements formed as above significantly (by 20-40%) increase the heat exchanger surface that may be built onto a given footprint and therewith the value of cooling capacity as well, thus decreasing the number of cooling towers required for the heat-removal of large units, and consequently the extent of any possible harmful interference between the cooling towers. Moreover, this arrangement decreases the flow resistance of the medium to be cooled as the speed of medium decreases by the increase in the number of cooling columns. This favourable effect is especially present in the case of vertical complex delta units made up of horizontal cooling deltas.

By exploiting the arrangement of the complex delta units, there is an opportunity to employ solutions that may decrease the costs of certain installations (distribution pipes of medium to be cooled, cooling tower construction and foundation, shutters for example), may decrease the wind-effect, and may improve winter-proofness of the cooling tower.

In the case of cooling systems operating at a temperature significantly below the freezing point, it may be necessary to have shutters regulating (or fully blocking) cooling air inlet. The arrangement according to the invention also enables a construction of especially advantageously variable shutters.

Figure 11:
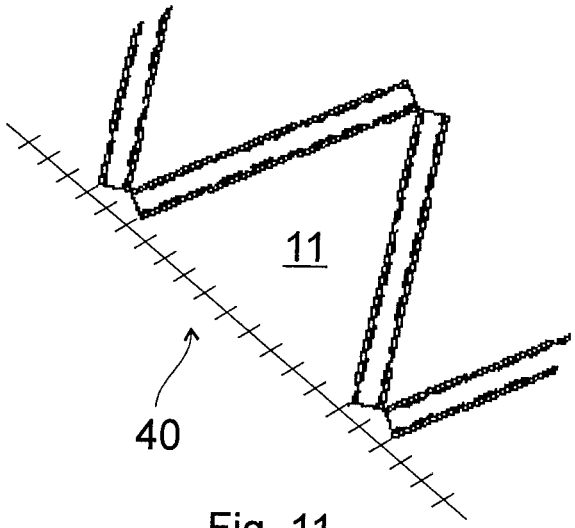
FIG. 11 is a schematic top view of the auxiliary shutter disposed at the air inlet side of the cooling deltas.

FIG. 11 shows a structure known per se, wherein the louvers are mounted onto individual cooling deltas 11 at the air inlet side. These conventional louvers may be used in addition to the new possibilities made available by the arrangement according to the present invention; therefore, these are referred to as individual louvers 40.

Figure 12:
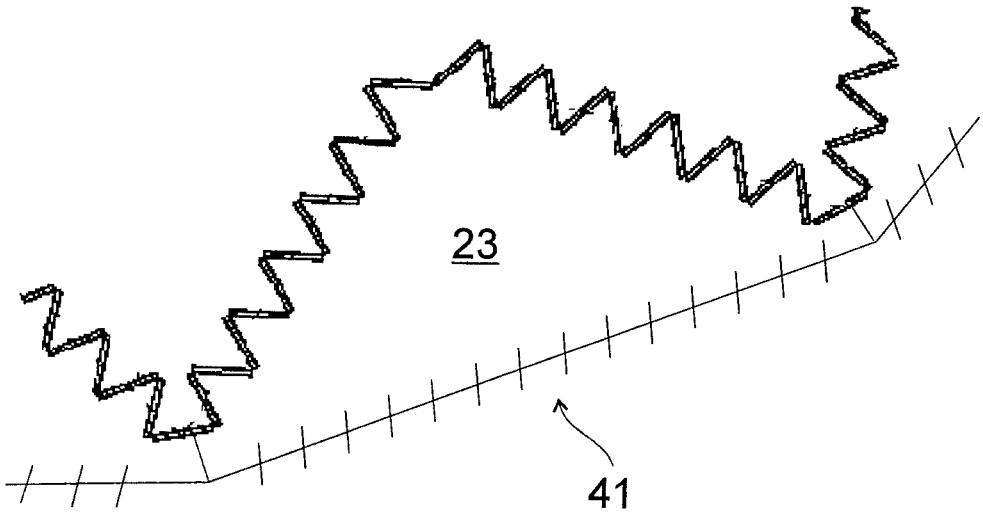
FIG. 12 is a schematic top view of the shutter disposed at the air inlet side of the complex delta units.

In the preferred embodiment according to FIG. 12, a shutter 41, being adapted for regulating the flow of the cooling air is arranged at the inlet side of the complex delta units 23. Taking advantage of the presence of the complex delta units 23, shutters 41 are disposed only on the complex delta units 23, instead of on each individual cooling delta 21, by which the surface to be shuttered as well as the number of shutter drives is significantly reduced, thereby further reducing the respective costs as well.

Due to the greater distance between the heat exchanger surfaces and the air flow-regulating shutter 41, the heat exchanger surfaces will have a more balanced air-load in the larger airspace thus emerged, thereby reducing the risk of any possible local frosting in extremely cold weather.

The shutter-leaves of the complex delta units 23 may be horizontally or vertically oriented. The shutter fields corresponding to each individual complex delta unit 23 may be divided into sub-fields in height or width direction, in order to avoid excessively large sizes. Division in the height direction enables separate operation for the subfields, e.g. full closure in the lower heights, while upper fields are partially open. This has special significance in decreasing the risk of frost on extraordinarily cold premises.

Figure 13:
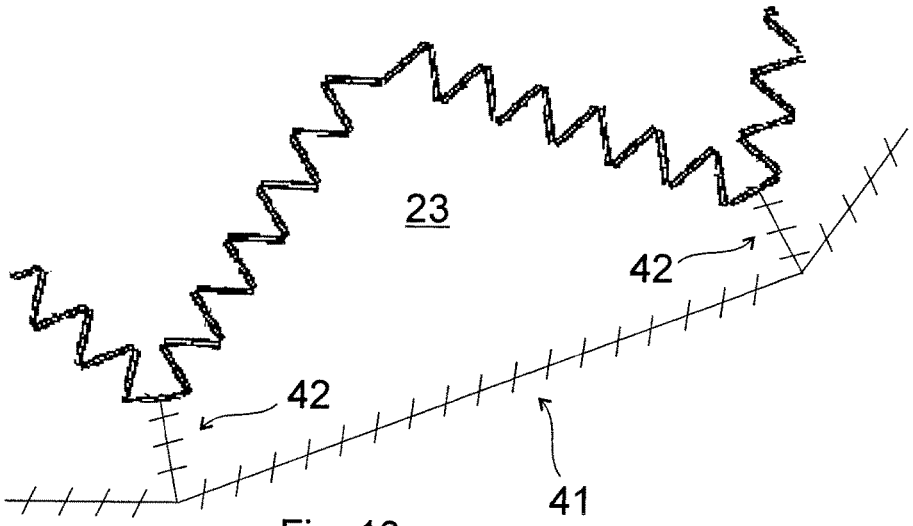
FIG. 13 is a schematic top view of the shutter disposed at the air inlet side of the complex delta units supplemented by auxiliary shutter.

An arrangement with shutter function also suitable for decreasing the harmful wind-effects may be formed in a manner as illustrated in FIG. 13, wherein the shutter 41 is placed away from the outward ends of the complex delta units 23 with a spacing so that an auxiliary shutter 42 is arranged between the shutter 41 and the outward end of the respective complex delta units 23. It is not required to dispose such closable and controllable auxiliary shutter 42 at each complex delta unit 23, it is sufficient to have an auxiliary shutter 42 disposed after each second, third or even fourth complex delta unit 23. Instead of having auxiliary shutters 42 arranged at the intermediate complex delta units 23, there may be disposed porous, i.e. partially permeable elements, as well. By adjusting the openness of the auxiliary shutter 42, the wind-effects can further be reduced. Increasing the space formed by the complex delta unit 23 and the corresponding shutter 41 makes the load on the air-cooling surfaces more balanced.

In the case of colder premises, it is more favourable to use the louver and shutter solutions of FIGS. 11 and 12 (or those of FIGS. 11 and 13) jointly. The louver arrangement according to FIG. 11 may be coupled with a shutter field disposed among the inward peaks of the complex delta units 23. This arrangement facilitates the pre-heating of air-cooling surfaces on restart on extremely cold premises.

The placement of peak coolers, pre-heaters or wet cells in the natural draft towers is a part of the known technology, one such solution is disclosed in EP 0 220 607 A1. It is to be emphasized that the star-like arrangements according to the present invention providing double-folded flow as illustrated in FIGS. 4 to 6 and FIGS. 7 to 10 also provide in general an especially favourable possibility for the placement of performance-improving peak coolers, wet cells and/or peak cooler/pre-heater cells. In these cases, an air channel independent from the main coolers and closable by a separate inlet shutter is required for providing cooling air for them.

Figure 14:
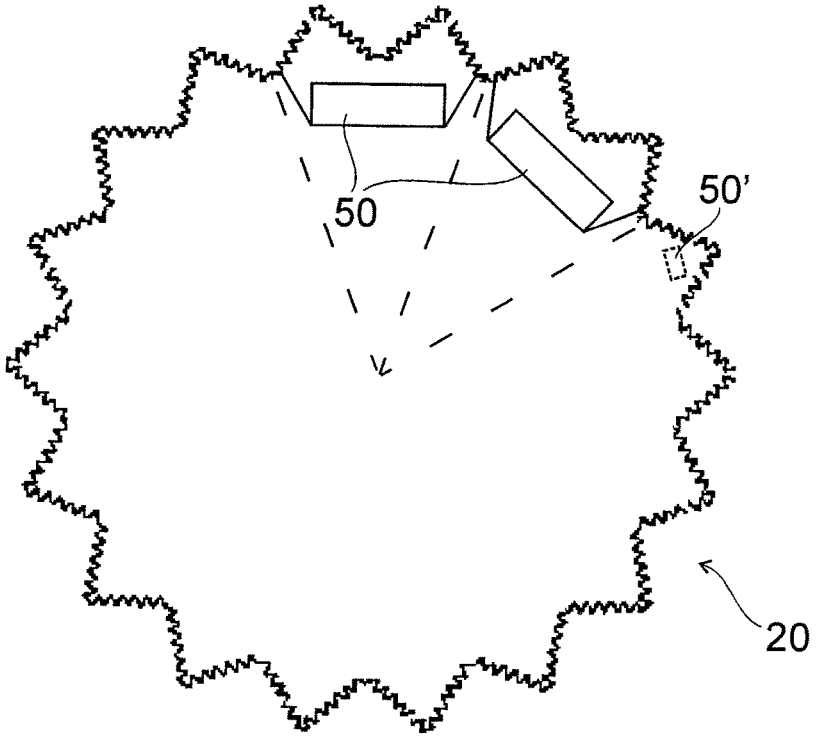
FIG. 14 is a possible schematic arrangement of peak coolers, wet cells and/or peak cooler/preheating cells.

Cells 50' are preferably arranged, by way of example, in the triangular-shaped corner-space-segments defined by adjacent complex delta units 23, 33. Somewhat larger cells 50 may preferably be connected by means of suitably formed air channels to two corresponding complex delta units 23, 30, as illustrated in FIG. 14.

The cell arrangements may be advantageous mainly in the case of complementary moderate wet heat exchange, for intensifying summer capacity. If more intense complementary wet cooling is required, then the wet cooling cells can be disposed either in a continuous full circle or in the middle part of the tower in a rectangular or circular arrangement covering a larger area. The complementary, purely wet cells may be disposed outside the dry cooling tower, as well.

The appropriately formed and regulated shutters can facilitate to decrease the negative effect of the wind. The shutter 41 may be formed of either horizontally or vertically placed shutter-leaves. In an advantageous, wind-effect decreasing solution of vertical shutter leaves used in the complex delta units 23, 33, the open shutter-leaves turn from the mid-line of the shutter-field, if viewed from the outside, in closing direction, contrary to each other towards the facing edge-line of the complex delta unit (the shutter-leaves on the right-hand side turn clockwise, while the ones on the left-hand side rotate counter-clockwise). In this case, the shutter comprises shutter-leaves oriented perpendicularly to the path, which shutter-leaves are rotated in closing direction guiding the cooling air towards the closest cooling delta group. By partially shifting the shutter-fields under the influence of the suction effect of the wind in closing direction, he air load of the segments opposite the wind or behind the wind can be made more balanced.

By means of the complex delta units comprising cooling deltas and implementing double-folded air flow, a favourable effect is present for the global fields of pressure and speed around the cooling tower, within particular ranges of wind-speed. The sideway air flow affecting the cooling tower will cause a local suction effect, decreasing the capacity of the cooling tower. The star-like configuration will induce turbulences to disturb this side-flow, thereby decreasing the suction effect.

Figure 15:
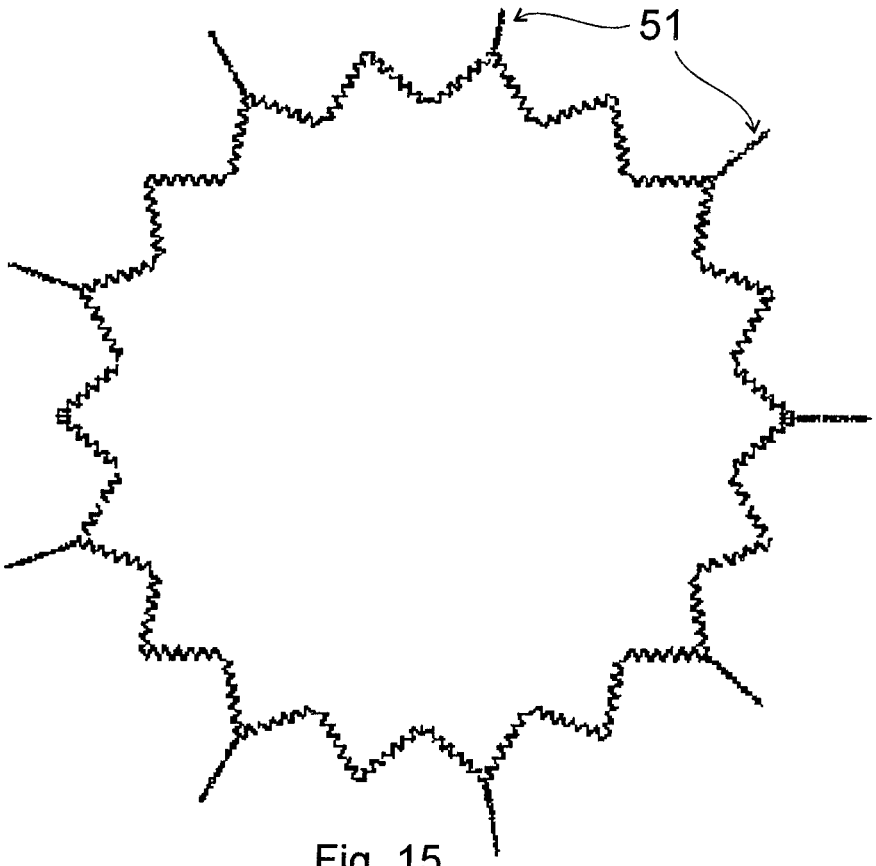
FIG. 15 is a top view of an arrangement according to the invention supplemented by windbreaker walls.

For promoting and stabilizing favourable pressure distribution and field of speed around the cooling tower, primarily on high-wind premises, it is preferable to use windbreaker walls. The star-like air-cooling arrangements implementing double-folded air flow provide a preferable possibility for including wind-effect reducing means. There are various ways provided for the placement of radial windbreaker elements. By way of example, they may be disposed at the protruding ends of the heat exchangers arranged in a star-like configuration, depending on the radial size not necessarily at each peak, but evenly distributed along the perimeter. The zigzagged path illustrated in FIG. 15 also forms an enclosed star-like configuration, and it has in at least some of its peaks vertically arranged windbreaker walls 51 protruding in external radial direction, having preferably partially perforated surfaces. The windbreaker walls 51 may also be full plates, nevertheless, a more advantageous effect is provided by porous, i.e. partially air-permeable perforated walls. The most effective solution is given when the windbreaker walls 51 have gradually increasing air-permeability starting from their respective parts radially most distant from the cooling tower towards the heat exchangers. Depending on the respective size of the radial direction, the use of one windbreaker wall 51 may suffice per every two or three complex delta units.

Figure 16:
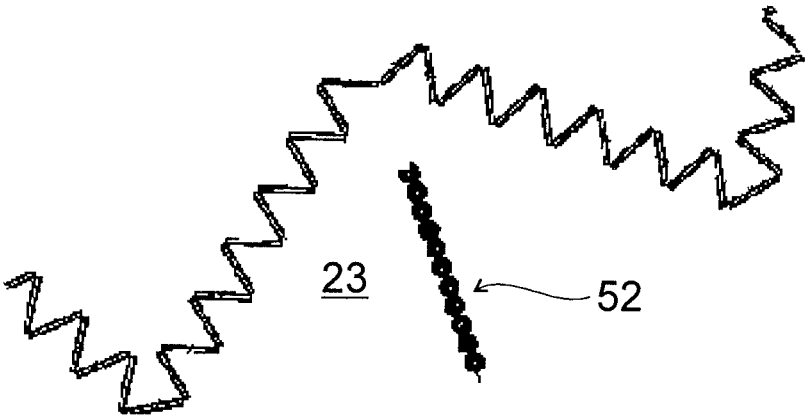
FIG. 16 is a top view of an arrangement according to the invention supplemented by windbreaker elements.

Windbreaker elements 52 disposed in a radially oriented vertical plane according to FIG. 16 may be included in-between the complex delta units 23 as well. Here, at some inward corners of the star-like configuration, windbreaker elements 52 protruding outwardly in a radial direction are disposed having preferably partially perforated surfaces. In this case, it is not required for the windbreaker elements 52 to extend to the inward corners of the complex delta units 23; they may start with a spacing. At the same time, they advantageously may extend over the line or arc defined by the adjacent external peaks of the complex delta units 23 by a few meters. In dependence of the rate of the overhang, it may be feasible to have such windbreaker elements 52 disposed at some of the complex delta units only. In this case, the most favourable solution is again provided by an air-permeability gradually increasing from the outside radially towards the inside.

By means of the cooling system according to the invention, a space-efficient, at the same time performance- and cost efficient dry or dry/wet cooling system can be formed. This arrangement can efficiently reduce wind-effects and provide a favourable possibility for placement of performance-improving peak cooling-cells, or pre-heating cells providing frost protection.

The invention is, of course, not limited to the preferred embodiments described in details above, but further modifications, variants and developments are possible within the scope of protection determined by the claims.

The invention claimed is:

1. A cooling system comprising adjacent cooling deltas being cooled by a cooling air, further comprising the cooling deltas including two cooling columns, the two cooling columns being arranged at an angle ($\alpha$) of 40° to 60° with respect to each other, the cooling deltas being arranged in groups, the cooling deltas of a group being arranged in the same orientation and defining a straight path-section, wherein the path-sections of adjacent groups form a zigzagged path, and wherein the pairs of adjacent groups form individual complex delta units being open from an incoming direction of the cooling air and having distribution and collection pipes, the complex delta units being configured to provide double-folded cooling airflow, and wherein the zigzagged path forms an enclosed star-like configuration.

2. The cooling system according to claim 1, characterised in that a shutter, being adapted for regulating a flow of the cooling air is arranged at an inlet side of the complex delta units.

3. The cooling system according to claim 2, characterised in that the shutter comprises shutter-leaves extending perpendicularly to the path, wherein the shutter-leaves are mounted to guide the cooling air towards the closest group when rotated in a closing direction.

4. The cooling system according to claim 2, characterised in that the shutter is arranged with a spacing from the complex delta units, and auxiliary shutters or porous, partially permeable elements are arranged between the shutter and the complex delta units.

5. The cooling system according to claim 1, characterised in that at least one windbreaker wall protruding outwardly in a radial direction and having a partially perforated surface is arranged proximate at least one peak of the star-like configuration.

6. The cooling system according to claim 1, characterised in that at least one windbreaker element protruding outwardly in a radial direction and having a partially perforated surface is arranged proximate at least one inward corner of the star-like configuration.

7. The cooling system according to claim 6, characterised in that inward ends of the windbreaker elements are arranged with a spacing from the inward corner, and their outward ends extend over a straight line connecting adjacent external peaks of the zigzagged path.

8. The cooling system according to claim 1, characterised in that at least one peak cooler, wet cell and/or combined peak cooler and pre-heater cell is arranged inside the enclosed star-like configuration.

9. The cooling system according to claim 8, characterised in that the at least one peak cooler, wet cell and/or combined peak cooler and pre-heater cell is arranged in a triangular-shaped corner space-section defined by two adjacent complex delta units.

10. The cooling system according to claim 8, characterised in that the at least one peak cooler, wet cell and/or combined peak cooler and pre-heater cell is connected to two adjacent complex delta units by means of an air channel.

11. The cooling system according to claim 2, characterised in that a shutter field corresponding to an individual complex delta unit is divided into sub-fields in height direction, enabling separate operation for the sub-fields.

12. The cooling system according to claim 1, further comprising vertically arranged complex delta units, in which the cooling deltas with their tubes containing medium to be cooled are oriented vertically, and wherein the distribution and collection pipes of the complex delta units are horizontal.

13. The cooling system according to claim 1, further comprising vertically arranged complex delta units, in which the cooling deltas with their tubes containing medium to be cooled are arranged nearly horizontally, and wherein the distribution and collection pipes of the complex delta units are vertical.

* * * * *